US005435896A

United States Patent [19]

Hardee et al.

[11] Patent Number: 5,435,896

[45] Date of Patent: * Jul. 25, 1995

[54] CELL HAVING ELECTRODES OF IMPROVED SERVICE LIFE

[75] Inventors: Kenneth L. Hardee, Middlefield; Lynne M. Ernes, Willoughby; Richard C. Carlson, Euclid, all of Ohio

[73] Assignee: ELTECH Systems Corporation, Chardon, Ohio

[ * ] Notice: The portion of the term of this patent subsequent to Jun. 28, 2011 has been disclaimed.

[21] Appl. No.: 217,830

[22] Filed: Mar. 25, 1994

Related U.S. Application Data

[60] Division of Ser. No. 904,314, Jun. 25, 1992, Pat. No. 5,314,601, which is a continuation-in-part of Ser. No. 633,914, Dec. 26, 1990, abandoned, which is a continuation-in-part of Ser. No. 374,429, Jun. 30, 1989, abandoned.

[51] Int. Cl.[6] ..... C25B 9/00

[52] U.S. Cl. ..... 204/247; 204/290 R; 204/290 F; 204/105 R; 204/59 R; 204/101; 205/305; 205/300; 205/67; 205/316

[58] Field of Search ..... 204/242, 290 R, 290 F, 204/105 R, 59 R, 101; 427/77, 126.2, 309, 422, 427; 205/305, 300, 316, 67

[56] References Cited

U.S. PATENT DOCUMENTS

| | | | |
|---|---|---|---|
| 3,265,526 | 8/1966 | Beer | 117/50 |
| 3,573,100 | 3/1971 | Beer | 134/3 |
| 3,632,498 | 1/1972 | Beer | 204/290 F |
| 3,650,861 | 3/1972 | Angell | 156/18 |
| 3,706,600 | 12/1972 | Pumphrey et al. | 134/3 |
| 3,711,385 | 6/1973 | Beer | 204/59 |
| 3,778,307 | 12/1973 | Beer et al. | 117/221 |
| 3,864,163 | 2/1975 | Beer | 117/217 |
| 3,878,083 | 4/1975 | De Nora et al. | 204/290 F |
| 3,882,002 | 5/1975 | Cook, Jr. | 204/98 |
| 3,948,736 | 4/1976 | Russell | 204/15 |
| 3,950,240 | 4/1976 | Cookfair et al. | 204/290 F |
| 4,005,003 | 1/1977 | Papplewell et al. | 204/290 F |
| 4,039,400 | 8/1977 | Hayfield et al. | 204/38 R |
| 4,068,025 | 1/1978 | Sahm | 427/309 |
| 4,140,813 | 2/1979 | Hund et al. | 427/34 |
| 4,255,247 | 3/1981 | Oda et al. | 204/293 |
| 4,272,354 | 6/1981 | de Nora et al. | 204/290 R |
| 4,328,080 | 5/1982 | Harris | 204/192 EC |
| 4,331,528 | 5/1982 | Beer et al. | 204/290 F |
| 4,392,927 | 7/1983 | Fabian et al. | 204/98 |
| 4,514,274 | 4/1985 | Heskett et al. | 204/290 F |
| 4,528,084 | 7/1985 | Beer et al. | 204/290 F |
| 4,572,770 | 2/1986 | Beaver et al. | 204/98 |
| 4,797,182 | 1/1989 | Beer et al. | 204/14.1 |
| 4,849,085 | 7/1989 | Debrodt et al. | 204/290 F |
| 5,019,224 | 5/1991 | Denton et al. | 204/54.1 |
| 5,098,546 | 3/1992 | Kawashima et al. | 204/290 R |

FOREIGN PATENT DOCUMENTS 1344540 4/1971 United Kingdom .

OTHER PUBLICATIONS

Shimizu, Titanium Electrode for the Manufacture of Electrolytic Manganese Dioxide; pp. 233–236; Furukawa Electric Co., Lmtd.; Tokyo, Japan.

Hayfield, Titanium as a Substrate for Electrodes; Birmingham, Eng. pp. 1–11; Figs. 1–13.

European Search Report, published Dec. 29, 1993, p. 14.

*Primary Examiner*—Kathryn Gorgos

*Attorney, Agent, or Firm*—John J. Freer; David J. Skrabec

[57] ABSTRACT

A metal surface, useful as an electrode in an electrolytic cell, is now described having enhanced adhesion of subsequently applied coatings combined with excellent coating service life. The substrate metal of the electrode, such as a valve metal as represented by titanium, is provided with a highly desirable rough surface characteristic for subsequent coating application. This can be achieved by various operations including etching and melt spray application of metal or ceramic oxide to ensure a roughened surface morphology. Usually in subsequent operations, a barrier layer is provided on the surface of enhanced morphology. This may be achieved by operations including heating, as well as including thermal decomposition of a layer precursor. Subsequent coatings provide enhanced lifetime even in the most rugged commercial environments.

11 Claims, No Drawings

CELL HAVING ELECTRODES OF IMPROVED SERVICE LIFE

CROSS-REFERENCE TO RELATED APPLICATION

This is a divisional, of application Ser. No. 07/904,314, filed Jun. 25, 1992, now U.S. Pat. No. 5,314,601 which in turn is a continuation-in-part of U.S. patent application Ser. No. 07/633,914 filed Dec. 26, 1990 (now abandoned), which in turn is a continuation-in-part of U.S. patent application Ser. No. 07/374,429 filed Jun. 30, 1989 (now abandoned).

TECHNICAL FIELD

The invention is directed to metal articles having surfaces providing enhanced coating adhesion and providing coated articles of extended service life. In particular the metal article can be an electrode and the coating an electroactive coating, with the electrode having an extended lifetime in an electrochemical cell.

BACKGROUND OF THE INVENTION

The adhesion of coatings applied directly to the surface of a substrate metal is of special concern when the coated metal will be utilized in a rigorous industrial environment. Careful attention is usually paid to surface treatment and pre-treatment operation prior to coating. Achievement particularly of a clean surface is a priority sought in such treatment or pre-treatment operation.

Representative of a coating applied directly to a base metal is an electrocatalytic coating, often containing a precious metal from the platinum metal group, and applied directly onto a metal such as a valve metal. Within this technical area of electrocatalytic coatings applied to a base metal, the metal may be simply cleaned to give a very smooth surface. U.S. Pat. No. 4,797,182. Treatment with fluorine compounds may produce a smooth surface. U.S. Pat. No. 3,864,163. Cleaning might include chemical degreasing, electrolytic degreasing or treatment with an oxidizing acid. U.S. Pat. No. 3,864,163.

Cleaning can be followed by mechanical roughening to prepare a surface for coating. U.S. Pat. No. 3,778,307. If the mechanical treatment is sandblasting, such may be followed by etching. U.S. Pat. No. 3,878,083. Or such may be followed by flame spray application of a fine-particle mixture of metal powders. U.S. Pat. No. 4,849,085.

Another procedure for anchoring the fresh coating to the substrate, that has found utility in the application of an electrocatalytic coating to a valve metal, is to provide a porous oxide layer which can be formed on the base metal. For example, titanium oxide can be flame or plasma sprayed onto substrate metal before application of electrochemically active substance, as disclosed in U.S. Pat. Nos. 4,140,813 and 4,331,528. Or the thermally sprayed material may consist of a metal oxide or nitride or so forth, to which electrocatalytically active particles have been pre-applied, as taught in U.S. Pat. No. 4,392,927.

It has, however, been found difficult to provide long-lived coated metal articles for serving in the most rugged commercial environments, e.g., oxygen evolving anodes for use in the present-day commercial application utilized in electrogalvanizing, electrotinning, electroforming or electrowinning. Such may be continuous operation. They can involve severe conditions including potential surface damage. It would be most desirable to provide coated metal substrates to serve as electrodes in such operation, exhibiting extended stable operation while preserving excellent coating adhesion. It would also be highly desirable to provide such an electrode not only from fresh metal but also from recoated metal.

SUMMARY OF THE INVENTION

There has now been found a surface which provides a locked on coating of excellent coating adhesion. The coated metal substrate can have highly desirable extended lifetime even in most rigorous industrial environments. The innovative metal surface allows for the use of low coating loadings to achieve lifetimes equivalent to anodes with much higher loadings or to achieve a more cost effective lifetime as measured on a basis of electrical charge passed per coating weight area. The metal substrate can now be coordinated with modified electrocatalytic coating formulations to provide electrodes of improved lifetime performance. The surface of the present invention lowers the effective current density for catalytically coated metal surfaces, thus also decreasing the electrode operating potential. Longer lived anodes translate into less down time and cell maintenance, thereby cutting operating costs.

In one aspect, the invention is directed to a method of preparing an electrode from a substrate metal, which method initially comprises providing a roughened surface by one or more steps of:

(a) intergranular etching of said substrate metal, which etching provides three-dimensional grains with deep grain boundaries; or (b) melt spray application of a valve metal layer onto said metal substrate; or (c) melt spraying of ceramic oxide particles onto said metal substrate; or (d) grit blasting of the metal substrate surface with sharp grit to provide a three-dimensional surface;

with the resulting roughened surface having a profilometer-measured average surface roughness of at least about 250 microinches and an average surface peaks per inch of at least about 40, with the peaks per inch being basis an upper threshold limit of 400 microinches and a lower threshold limit of 300 microinches; there being established in step (c) a ceramic oxide barrier layer of such roughened surface on the metal substrate, there thus being subsequently established after any of steps (a), (b), and (d), a ceramic oxide barrier layer on the roughened surface, which barrier layer is provided by one or more steps of:

(1) heating such roughened surface in an oxygen-containing atmosphere to an elevated temperature in excess of about 450° C. for a time of at least about 15 minutes; or (2) applying a metal oxide precursor substituent, with or without doping agents, to the roughened surface, the metal oxide precursor substituent providing a metal oxide on heating, followed by thermally treating the substituent at an elevated temperature sufficient to convert metal oxide precursor to metal oxide; or (3) establishing on such roughened surface a suboxide layer by chemical vapor deposition of a volatile starting material, with or without doping compounds, which is transported via an inert gas carrier to the surface that is heated to a temperature of at least about 250° C; or (4) melt spraying ceramic oxide particles onto the roughened surface;

with there being maintained for said barrier-layer-containing surface such profilometer-measured average surface roughness of at least about 250 microinches and an average surface peaks per inch of at least about 40, the resulting barrier-layer-containing surface being subsequently treated by:

applying to said barrier-layer-containing surface an electrocatalytic coating, thereby preparing the electrode.

In another aspect, the invention is directed to an electrode metal substrate, such as prepared by the method described hereinabove, as well as otherwise further defined herein. In a still further aspect, the invention is directed to a cell for electrolysis, with the cell having at least one electrode of a metal article as defined herein. In as yet another aspect the invention is directed to an electrode having a special coating particularly adapted for such electrode. When the metal substrates of the invention are electrocatalytically coated and used as oxygen evolving electrodes, even under the most rigorous commercial operations including continuous electrogalvanizing, electrotinning, copper foil plating, electroforming or electrowinning, and including sodium sulfate electrolysis, such electrodes can have highly desirable service life. The innovations of the present invention are thus particularly applicable to high speed plating applications which involve a process incorporating one or more electrochemical cells having a moving strip cathode, an oxygen evolving anode and a solution containing one or more plateable metal ions, typically with associated supporting electrolytes and additives. Representative cell configurations include flooded cells, falling electrolyte cells and radial jet type cells.

DESCRIPTION OF THE PREFERRED EMBODIMENTS

The metals of the substrate are broadly contemplated to be any coatable metal. For the particular application of an electrocatalytic coating, the substrate metal might be such as nickel or manganese, but will most always be valve metals, including titanium, tantalum, aluminum, zirconium and niobium. Of particular interest for its ruggedness, corrosion resistance and availability is titanium. As well as the normally available elemental metals themselves, the suitable metals of the substrate can include metal alloys and intermetallic mixtures, as well as ceramics and cermets such as contain one or more valve metals. For example, titanium may be alloyed with nickel, cobalt, iron, manganese or copper. More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10, from 10 to 13 weight percent plus 4.5 to 7.5 weight percent zirconium and so on.

By use of elemental metals, it is most particularly meant the metals in their normally available condition, i.e., having minor amounts of impurities. Thus, for the metal of particular interest, i.e., titanium, various grades of the metal are available including those in which other constituents may be alloys or alloys plus impurities. Grades of titanium have been more specifically set forth in the standard specifications for titanium detailed in ASTM B 265-79.

Regardless of the metal selected and how the metal surface is subsequently processed, the substrate metal advantageously is a cleaned surface. This may be obtained by any of the treatments used to achieve a clean metal surface, but with the provision that unless called for to remove an old coating, and if etching might be employed, as more specifically detailed hereinbelow, mechanical cleaning is typically minimized. Thus, the usual cleaning procedures of degreasing, either chemically or electrolytic, or other chemical cleaning operation may be used to advantage.

Where an old coating is present on the metal surface, such needs to be addressed before recoating. It is preferred for best extended performance when the finished article will be used with an electrocatalytic coating, such as use as an oxygen evolving electrode, to remove the old coating. In the technical area of the invention which pertains to electrochemically active coatings, coating removal methods are well known. Thus a melt of essentially basic material, followed by an initial pickling will suitably reconstitute the metal surface, as taught in U.S. Pat. No. 3,573,100. Or a melt of alkali metal hydroxide containing alkali metal hydride, which may be followed by a mineral acid treatment, is useful, as described in U.S. Pat. No. 3,706,600. Usual rinsing and drying steps can also form a portion of these operations.

When a cleaned surface, or prepared and cleaned surface has been obtained, and particularly for later applying an electrocatalytic coating to a valve metal in the practice of the present invention, surface roughness is then obtained. This will often be referred to herein as a "suitably roughened metal surface." This will be achieved by means which include intergranular etching of the substrate metal, plasma spray application, which spray application can be of particulate valve metal or of ceramic oxide particles, or both, and sharp grit blasting of the metal surface, followed by surface treatment to remove embedded grit. For efficient as well as economical surface roughening plasma spray is preferred.

Where the surface roughness is obtained by etching, it is important to aggressively etch the metal surface to provide deep grain boundaries providing well exposed, three-dimensional grains. It is preferred that such operation will etch impurities located at such grain boundaries. There can be an inducement at, or introduction to, the grain-boundaries of one or more impurities for the metal. For example, with the particularly representative metal titanium, the impurities of the metal might include iron, nitrogen, carbon, hydrogen, oxygen, and beta-titanium. One particular manner contemplated for impurity enhancement is to subject the titanium metal to a hydrogen-containing treatment. This can be accomplished by exposing the metal to a hydrogen atmosphere at elevated temperature. Or the metal might be subjected to an electrochemical hydrogen treatment, with the metal as a cathode in a suitable electrolyte evolving hydrogen at the cathode.

Another consideration for the aspect of surface roughening involving etching, which aspect can lead to impurity enhancement at the grain boundaries, involves the heat treatment history of the metal. For example, to prepare a metal such as titanium for etching, it can be most useful to condition the metal, as by annealing, to diffuse impurities to the grain boundaries. Thus, by way of example, proper annealing of grade 1 titanium will enhance the concentration of the iron impurity at grain boundaries. Also for the aspect of etching, it can be desirable to combine a metal surface having a correct grain boundary metallurgy with an advantageous grain size. Again, referring to titanium as exemplary, at least a substantial amount of the grains having grain size number within the range of from about 3 to about 7 is advantageous. Grain size number as referred to herein is in accordance with the designation provided in ASTM E 112-84.

Etching will be with a sufficiently active etch solution to develop aggressive grain boundary attack. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide, or a melt of potassium hydroxide with potassium nitrate. Following etching, the etched metal surface can then be subjected to rinsing and drying steps. The suitable preparation of the surface by etching has been more fully discussed in copending U.S. patent application Ser. No. 686,962, which application is incorporated herein by reference.

In plasma spraying for a suitably roughened metal surface, although the material will be applied in particulate form such as droplets of molten metal, the feed material, e.g., a metal to be applied, may be in different form such as wire form. This is to be understood even though for convenience, application will typically be discussed as material applied in particulate form. In this plasma spraying, such as it would apply to spraying of a metal, the metal is melted and sprayed in a plasma stream generated by heating with an electric arc to high temperatures in inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying, so that the spraying may simply be referred to as "melt spraying".

The spraying parameters, such as the volume and temperature of the flame or plasma spraying stream, the spraying distance, the feed rate of the constituents being sprayed and the like, are chosen so that, for the spraying of metal or oxide, it is melted by and in the spray stream and deposited on the metal substrate while still substantially in melted form. For either metal or ceramic oxide, the spraying is to almost always provide an essentially continuous coating having a rough surface structure, although it is contemplated that the spraying may be in strip form, with unsprayed strips between the sprayed strips, or in some other partial coating pattern on the substrate. The surface will have a three-dimensional character similar in appearance to a surface following a grain boundary etch. Typically, spray parameters like those used in the examples give satisfactory results. Usually, the metal substrate during melt spraying is maintained near ambient temperature. This may be achieved by means such as streams of air impinging on the substrate during spraying or allowing the substrate to air cool between spray passes.

The particulate metal employed, e.g., titanium powder, has a typical particle size range of 0.1–500 microns, and preferably has all particles within the range of 15–325 microns for efficient preparation of surface roughness. Particulate metals having different particle sizes should be equally suitable so long as they are readily plasma spray applied. The metallic constituency of the particles may be as above-described for the metals of the substrate, e.g., the titanium might be one of several grades most usually grade 1 titanium or an alloy of titanium. It is also contemplated that mixtures may be applied, e.g., mixtures of the metals and the ceramic oxides, or the metals and oxides may be cosprayed, or sprayed in layers, for example an oxide layer sprayed onto a spray applied metal layer. Where the spray application will result in layers, the top layer should be an oxide or cosprayed layer.

The ceramic oxide, which may also be referred to herein as the "conductive oxide" utilized in the melt spray procedure can be in particulate form, e.g., titanium oxide powder having a particle size that correlates generally to the particle size that would be used if titanium metal were being sprayed, typically within the range of 10–400 microns. The size of the oxide powder can also be varied in the melt spray operation to control the resulting density of the oxide layer. More finely divided powder generally provides a more dense, less rough layer. In addition to the melt spraying of the usual valve metal oxides, e.g., titanium oxide, tantalum oxide and niobium oxide, it is also contemplated to melt spray titanates, spinels, magnetite, tin oxide, lead oxide, manganese oxide and perovskites. It is also contemplated that the oxide being sprayed can be doped with various additives including dopants in ion form such as of niobium or tin or indium.

It is also contemplated that such plasma spray applications may be used in combination with etching of the substrate metal surface. Or the substrate may be first prepared by grit blasting, as discussed hereinabove, which may or may not be followed by etching. However, where a metal or conductive oxide is to be melt sprayed onto the surface already exhibiting the desired surface roughness, the grit blasting will almost always have been followed by treatment to remove embedded grit. Hence, it is to be understood that where a substrate surface preparation has been utilized to achieve desirable roughness characteristic, the melt spraying of a conductive oxide or of a metal may be subsequently utilized to combine the protective effect of the melt spray applied layer, plus retain the desirable surface morphology of the underlying substrate. The oxide material or metal can be deposited onto a previously prepared surface through melt spraying, and in a manner to conform to the surface topography of the underlying metal surface and not deleteriously reduce the effect of surface roughness.

It is to be however kept in mind that in the alternative the melt sprayed oxides can themselves generate desirable surface roughness. However, the combination of an underlying desired surface roughness and a melt sprayed oxide or metal that at least maintains such roughness will provide the preferred surface.

It will be understood that particularly with the melt spray application of conductive oxide, several layers can be applied by the plasma spray operation. Normally, the oxide will be sprayed to achieve a barrier layer thickness of on the order of about 0.001 to about 0.025 inch. Also, after application, the applied layer can be heat treated, e.g., to provide a different crystal form of the applied conductive oxide. Such as for modifying the conductivity of the oxide. Such heat treatment may be conducted in air, inert gas, such as argon, vacuum, or reducing environment, e.g., hydrogen gas environment.

It has also been found that a suitably roughened metal surface can be obtained by special grit blasting with sharp grit followed by removal of surface embedded grit. The grit, which will contain usually angular particles, will cut the metal surface as opposed to peening the surface. Serviceable grit for such purpose can include sand, aluminum oxide, steel and silicon carbide. Upon grit removal, this can provide a suitably roughened, three-dimensional surface. Etching, or other treatment such as water blasting, following grit blasting can remove embedded grit and provide the desirably roughened surface. Regardless of the technique employed to reach the suitably prepared roughened surface, e.g., plasma spray or intergranular etch, it is necessary that the metal surface have an average roughness (Ra) of at least about 250 microinches and an average number of surface peaks per inch (Nr) of at least about 40. The surface peaks per inch can be typically measured at a lower threshold limit of 300 microinches and an upper threshold limit of 400 microinches. A surface having an average roughness of below about 250 microinches will be undesirably smooth, as will a surface having an average number of surface peaks per inch of below about 40, for providing the needed, substantially enhanced, coating adhesion. Advantageously, the surface will have an average roughness of on the order of about 300 microinches or more., e.g., ranging up to about 750–1500 microinches, with substantially no low Spots of less than about 200 microinches. Advantageously, for best avoidance of surface smoothness, the surface will be free from low spots that are less than about 210 to 220 microinches. It is preferable that the surface have an average roughness of from about 350 to about 500 microinches. Advantageously, the surface has an average number of peaks per inch of at least about 60, but which might be on the order of as great as about 130 or more, with an average from about 70 to about 120 being preferred. It is further advantageous for the surface to have an average distance between the maximum peak and the maximum valley (Rz) of at least about 1,000 microinches and to have a maximum peak height (Rm) of at least about 1,000 microinches. More desirably, the surface for coating will have an Rm value of at least about 1,500 microinches up to about 3500 microinches and have an average distance between the maximum peak and the maximum valley characteristic of at least about 1,500 microinches up to about 3500 microinches. All of such foregoing surface characteristics are as measured by a profilometer.

Following the obtaining of the suitably prepared roughened surface, some procedures may be needed, and several can be utilized, to prepare the necessary barrier layer. It is contemplated that a melt sprayed ceramic oxide roughened surface may also serve as a satisfactory barrier layer. Where surface roughening has not also provided a serviceable barrier layer, it is preferred for economy to form a suitable barrier layer on the metal substrate by heating the metal substrate in an oxygen-containing atmosphere. Roughened metal surfaces suitable for heat treatment will thus include grain boundary etched surfaces, those with sharp-grit blasting with follow-up grit removal and surfaces having melt sprayed metal. Most always, this heat treatment will be used with a representative titanium metal substrate surface. Heating can be conducted in any oxygen-containing atmosphere, with air being preferred for economy. For the representative titanium metal surface, a serviceable temperature for this heating to obtain barrier layer formation will generally be within a range of in excess of about 450° C. but less than about 700° C. It will be understood that such heat treatment at a temperature within this range in an oxygen containing atmosphere will form a surface oxide barrier layer on the metal substrate. For the representative titanium metal, the preferred temperature range for the oxygen atmosphere heating is from about 525° C. to about 650° C. Typically, the metal will be subject to such elevated temperature heating for a time of from about 15 minutes to about 2 hours or even more, preferred times for the representative titanium metal are within the range of from about 30 minutes to about 60 minutes. A wash solution of a doping agent may be used with this thermal treatment. Doping agents such as niobium chloride to provide niobium, or a tantalum or vanadium salt to provide such constituents in ionic form, can be present in the wash solution.

It is also contemplated that for an etched, or sharp grit blasted, with surface grit removed, or melt sprayed metal prepared surface, that an effective barrier layer may be obtained on such surface using a suitable precursor substituent and thermal treatment to convert the precursor substituent to an oxide. Where this thermal decomposition treatment with precursor substituent will be used, for a representative titanium oxide barrier layer, suitable precursor substituents can be either organic or inorganic compositions. Organic precursor substituents include titanium butyl orthotitanate, titanium ethoxide and titanium propoxide. Suitable inorganic precursor substituents can include $TiCl_3$ or $TICl_4$, usually in acid solution. Where tin oxide is the desired barrier layer constituent, suitable precursor substituents can include $SnCl_4$, $SnSO_4$, or other inorganic tin salts.

It is also contemplated that such precursor substituents may be used with doping agents, such as those which would be incorporated as doping agent precursors into the composition to increase the conductivity of the resulting barrier layer oxide. For example a niobium salt may be used to provide a niobium doping agent in ion form in the oxide lattice. Other doping agents include ruthenium, iridium, platinum, rhodium and palladium, as well as mixtures of any of the doping agents. It has been known to use such doping agents for titanium oxide barrier layers. Doping agents suitable for a tin oxide barrier layer include antimony, indium or fluorine.

The precursor substituent will suitably be a precursor solution or dispersion containing a dissolved or dispersed metal salt in liquid medium. Such composition can thus be applied to a suitably prepared surface by any usual method for coating a liquid composition onto a substrate, e.g., brush application, spray application including air or electrostatic spray, and dipping. In addition to dopants which may be present in the applied precursor composition, such composition might additionally contain other materials. These other materials may be particulates and such particulates can take the shape of fibers. The fibers may serve to enhance coating integrity or enhance the three-dimensional surface morphology. These fibers can be silica-based, for example glass fibers, or may be other oxide fibers such as valve metal oxide fibers including titanium oxide and zirconium oxide fibers, as well as strontium or barium titanate fibers, and mixtures of the foregoing. In the coating composition, additional ingredients can include modifiers which will most generally be contained in compositions containing precursor substituents to titanium oxides. Such modifiers are useful for minimizing any mud cracking of the barrier layer during the thermal treatment cycles.

For the thermal oxidation of the metal salts applied to the substrate, such will generally be conducted in an oxygen containing environment, preferably air for economy, at a temperature within the range of from greater than about 400° C. up to about 650° C. For efficient thermal conversion, a preferred temperature will be is in the range of from about 500° C. to about 600° C. Where the coating is applied as a liquid medium, such thermal treatment will serviceably be observed after each applied coating with such temperature being maintained from about 1 minute to about 60 minutes per coat. Preferably, for efficiency and economy, the temperature will be maintained from about 3 to about 10 minutes per coat. The number of coating cycles can vary depending upon most typically the required amount of barrier layer, with 5 to 40 coats being usual, although fewer coatings, and even a single coating, is contemplated.

Usually, the number of coats for a representative titanium oxide coating, such as formed by the thermal decomposition of titanium butyl orthotitanate, will not exceed on the order of about 20, and advantageously for economy will not exceed about 10. Preferably, for economy plus efficient electrode lifetime, such will be less than 10 coats. The resulting amount of barrier layer will usually not exceed about 0.025 inch for economy.

In a procedure also requiring heat application, and thus not completely unlike thermal oxidation of an applied precursor, it is also contemplated to form a suitable barrier layer by chemical vapor deposition method. For this method, there can be utilized a suitable volatile starting material such as one of the organic titanium compounds mentioned hereinabove with the thermal oxidation procedure, e.g., titanium butyl orthotitanate, titanium ethoxide or titanium propoxide. In this chemical vapor deposition method for obtaining a serviceable barrier layer, the volatile starting material can be transported to a suitably prepared roughened surface by an inert carrier gas, including nitrogen, helium, argon, and the like. This compound is transported to a heated substrate which is heated to a temperature sufficient to oxidize the compound to the corresponding oxide. For application of organic titanium compound, such temperature can be within the range from about 250° C. to about 650° C. As has been discussed hereinbefore with thermal oxidation treatment, it is also suitable to utilize in the chemical vapor deposition procedure a doping compound. Such doping compounds have been discussed hereinabove. For example, a niobium salt may be added to the carrier gas transporting the volatile starting material, or such may be applied to the heated substrate by means of a separate carrier gas stream. As with the thermal oxidation process, this chemical vapor deposition procedure is most particularly contemplated for use following preparation of a suitably prepared toughened surface by etching, or by sharp grit blasting followed by surface treatment, or by melt spraying of metal.

Subsequent to the formation of the barrier layer over the suitably prepared roughened surface, the subsequent article may be subjected to further treatment. Additional treatments can include thermal treatment, such as annealing of the barrier layer oxide. For example, where the barrier layer comprises a deposition of $TiO_x$, annealing can be useful for converting the deposited oxide to a different crystal form or for modifying the value of the "x". Such annealing may also be serviceably employed for adjusting the conductivity of the deposited barrier layer. Where such additional treatments are thermal treatments, they can include heating in any of a variety of atmospheres, including oxygen-containing environments, such as air, or heating in inert gas environment, such as argon, or in a reducing gas environment, for example, hydrogen or hydrogen mixtures such as hydrogen with argon, or heating in a vacuum. It is to be understood that these additional treatments may be utilized for a barrier layer achieved in any manner as has been discussed herein.

Subsequent to the formation of the barrier layer, it is necessary that the metal surface have maintained an average roughness (Ra) of at least about 250 microinches and an average number of surface peaks per inch (Nr) of at least about 40. Advantageously, the surface will have maintained an average roughness of on the order of about 300 microinches or more, e.g., ranging up to about 750–1500 microinches, with substantially no low spots of less than about 200 microinches. It is preferable that the surface have maintained an average roughness of from about 350 to about 500 microinches. Advantageously, the surface has an average number of peaks per inch of at least about 60, but which might be on the order of as great as about 130 or more, with an average from about 70 to about 120 being preferred. It is further advantageous for the surface to have Rm and Rz values as for the suitably prepared roughened surface, which values have been discussed hereinbefore.

After the substrate has attained the necessary barrier layer, it will be understood that it may then proceed through various operations, including pretreatment before coating. For example, the surface may be subjected to a cleaning operation, e.g., a solvent wash. It is to be understood that in some instances of melt spray application of ceramic oxide, e.g., of $SnO_2$, the barrier layer may then serve as the electrocatalytic surface without further coating application. Alternatively, various proposals have been made in which an outer layer of electrochemically active material is deposited on the barrier layer which primarily serves as a protective and conductive intermediate. U.K. Pat. No. 1,344,540 discloses utilizing an electrodeposited layer of cobalt or lead oxide under a ruthenium-titanium oxide or similar active outer layer. It is also to be understood that subsequent to the preparation of the barrier layer, but prior to the application of a subsequent electrocatalytic coating, intermediate coatings may be employed. Such intermediate coatings can include coatings of platinum group metals or oxides. Various tin oxide based underlayers are disclosed in U.S. Pat. No. Nos. 4,272,354, 3,882,002 and 3,950,240. After providing the barrier layer followed by any pretreatment operation, the coating most contemplated in the present invention is the application of electrochemically active coating.

As representative of the electrochemically active coatings that may then be applied, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos.

3,265,526, 3,632,498, 3,711,385, and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those such as the tin oxide enumerated above include manganese dioxide, lead dioxide, cobalt oxide, ferric oxide, platinate coatings such as $M_xPt_3O_4$ where M is an alkali metal and X is typically targeted at approximately 0.5, nickel-nickel oxide and nickel plus lanthanide oxides.

Although the electrocatalytic coating may serviceably be iridium oxide, where the coating will contain the iridium oxide together with tantalum oxide, it has been found that improved lifetimes for the resulting article as an electrode can be achieved by adjusting upward the iridium to tantalum mole ratio. This ratio will be adjusted upwardly from an iridium to tantalum mole ratio, as metal from above 75:25 to advantageously above 80:20. The preferred range for best achieved lifetime performance will be from about 25 80:20 to about 90:10, although higher ratios, e.g., up to as much as 99:1 can be useful. Such coatings will usually contain from about 4 to about 50 grams per square meter of iridium, as metal. For obtaining these improved lifetime coatings, the useful coating composition solutions are typically those comprised of $TaCl_3$, $IrCl_3$ and hydrochloric acid, all in aqueous solution. Alcohol based solutions may also be employed. Thus, the tantalum chloride can be dissolved in ethanol and this mixed with the iridium chloride dissolved in either isopropanol or butanol, all combined with small additions of hydrochloric acid.

It is contemplated that coatings will be applied to the metal by any of those means which are useful for applying a liquid coating composition to a metal substrate. Such methods include dip spin and dip drain techniques, brush application, roller coating and spray application such as electrostatic spray. Moreover, spray application and combination techniques, e.g., dip drain with spray application can be utilized. With the above-mentioned coating compositions for providing an electrochemically active coating, a roller coating operation can be most serviceable. Following any of the foregoing coating procedures, upon removal from the liquid coating composition, the coated metal surface may simply dip drain or be subjected to other post coating technique such as forced air drying.

Typical curing conditions for electrocatalytic coatings can include cure temperatures of from about 300° C. up to about 600° C. Curing times may vary from only a few minutes for each coating layer up to an hour or more, e.g., a longer cure time after several coating layers have been applied. However, cure procedures duplicating annealing conditions of elevated temperature plus prolonged exposure to such elevated temperature, are generally avoided for economy of operation. In general, the curing technique employed can be any of those that may be used for curing a coating on a metal substrate. Thus, oven coating, including conveyor ovens may be utilized. Moreover, infrared cure techniques can be useful. Preferably for most economical curing, oven curing is used and the cure temperature used for electrocatalytic coatings will be within the range of from about 450° C. to about 550° C. At such temperatures, curing times of only a few minutes, e.g., from about 3 to 10 minutes, will most always be used for each applied coating layer.

In addition to the resulting article being serviceable as an anode for electrogalvanizing, such may also be useful as an anode in an electrotinning operation opposite a moving cathode, such as a moving steel strip. As an anode, the finished article can also find service in copper foil production. Service for the article as an anode can also be found in current balancing where anodes are placed electrically parallel with consumable anodes. It is also contemplated that the finished fabricated articles can be suitably employed in electrochemical cells having an oxygen evolving anode in a non-plating application such as in a separated cell having a hydrogen-evolving cathode. A particular application would include use in acid recovery or in an acid generation process, such as sodium sulfate electrolysis or chloric acid production, the article being used as an anode in a cell which is typically a multi-compartment cell with diaphragm or membrane separators. In certain applications it is also contemplated that the fabricated article as an anode may comprise essentially an outer coating layer of a conductive, non-platinum metal oxide such as a doped tin oxide. Such an anode may be utilized in a process including peroxy compound formation.

The following examples show ways in which the invention has been practiced, as well as showing comparative examples. However, the examples showing ways in which the invention has been practiced should not be construed as limiting the invention.

EXAMPLE 1

A titanium plate measuring 2 inches by 6 inches by ⅜ inch and being an unalloyed grade 1 titanium plate, was degreased in perchloroethylene vapors, rinsed with deionized water and air dried. It was then etched for approximately one hour by immersion in 18 weight percent hydrochloric acid aqueous solution heated to 95°–100° C. After removal from the hot hydrochloric acid, the plate was again rinsed with deionized water and air dried. The etched surface was then subjected to surface profilometer measurement using a Hommel model T1000 C. instrument manufactured by Hommelwerk GmbH. The plate surface profilometer measurements were taken by running the instrument in a random orientation across a large flat face of the plate. This gave values for surface roughness (Ra) of 653 microinches and peaks per inch (Nr) of 95.

The etched titanium plate was placed in an oven heated to 525° C. This air temperature was then held for one hour. The sample was then permitted to air cool. This heating provided an oxide barrier layer on the surface of the titanium plate sample. The resulting thickness of the oxide layer was less than one micron. Surface roughness was thereafter measured and the results obtained were essentially the same as above. This titanium sample plate was then provided with an electrochemically active oxide coating of tantalum oxide and iridium oxide having a 65:35 weight ratio of Ir:Ta, as metal. The coating composition was an aqueous, acidic solution of chloride salts, and the coating was applied in layers, each layer being baked in air at 525° C. for ten minutes. The coating weight achieved was 10.5 gms/$m^2$.

The resulting sample was tested as an anode in an electrolyte that was 150 grams per liter (g/l) of sulfuric acid. The test cell was an unseparated cell maintained at 65° C. and operated at a current density of 70 kiloamps per square meter (kA/$m^2$). Periodically the electrolysis was briefly interrupted. The coated titanium plate anode was removed from the electrolyte, rinsed in deionized water, air dried and then cooled to ambient temperature. There was then applied to the coated plate surface, by firmly manually pressing onto the coating, a strip of self-adhesive, pressure sensitive tape. This tape was then removed from the surface by quickly pulling the tape away from the plate.

The coating remained well-adhered throughout the test, with the anode ultimately failing by anode passivation with the coating still predominantly intact at 4,927 kA-hr/m$^2$-gm of iridium.

Comparative Example 1A:

A titanium plate sample of unalloyed grade 1 titanium, was etched to provide desirable surface roughness. Subsequent profilometer measurements, conducted in the manner of Example 1, provided average values of 551 (Ra) and 76 (Nr). This titanium plate, with no barrier layer (thus making it a comparative example) was coated with the composition of Example 1 and in the manner of Example 1 to the coating weight of Example 1. The coated plate was then tested as in Example 1 and the anode plate failed by passivation at 1,626 kA-hr/m$^2$-gm of iridium.

Comparative Example 1B:

A titanium plate sample as in Example 1 was left smooth. Subsequent profilometer measurements conducted in the manner of Example 1, provided average values of $<100$ (Ra) and 0 (Nr). Also, no barrier layer was provided for this comparative sample plate. The plate was nevertheless coated with the composition of Example 1 and in the manner of Example 1 to the coating weight of Example 1. The coated plate was then tested as in Example 1 and the anode failed by passivation at 616 kA-hr/m$^2$ gm of iridium.

The anode passivation test results for these Example 1, 1A and 1B series of panels are set forth in the table below:

TABLE

| Anode | Time to Passivation (kA-hr/M$^2$-gm of Iridium) |
|---|---|
| Example 1 Rough Surface Plus Barrier Layer | 4,927 |
| Comparative Example 1A Rough Surface, No Barrier Layer | 1,626 |
| Comparative Example 1B No Rough Surface, No Barrier Layer | 616 |

EXAMPLE 2

An unalloyed grade 1 titanium plate was prepared with a suitable roughness by grit blasting with aluminum oxide, followed by rinsing in acetone and drying. A coating on the sample plate of titanium powder was produced using a powder having all particles within the size range of 15–325 microns. The sample plate was coated with this powder using a Metco plasma spray gun equipped with a GH spray nozzle. The spraying conditions were: a current of 500 amps; a voltage of 45–50 volts; a plasma gas consisting of argon and helium; a titanium feed rate of 3 pounds per hour; a spray bandwidth of 6.7 millimeters (mm); and a spraying distance of 64 mm, with the resulting titanium layer on the titanium sample plates having a thickness of about 100 microns.

The coating surface of the sample plate was then subjected to surface profilometer measurement using a Hommel model T1000 C. instrument manufactured by Hommelwerk GmbH. The plate surface profilometer measurements were determined as average values computed from three separate measurements conducted by running the instrument in random orientation across the coated flat face of the plate. This gave an average value for surface roughness (Ra) of 759 microinches and peaks per inch (Nr) of 116. The peaks per inch were measured within the threshold limits of 300 microinches (lower) and 400 microinches (upper).

The plasma sprayed titanium plate was placed in an oven heated to 525° C. This air temperature was then held for one hour followed by air cooling. This heating provided an oxide barrier layer on the surface of the plasma spray applied titanium layer on the plate sample. Surface roughness was essentially the same as above.

This titanium sample plate was then provided with an electrochemically active oxide coating of tantalum oxide and iridium oxide having a 65:35 weight ratio of Ir:Ta, as metal. The coating composition was an aqueous, acidic solution of chloride salts, and the coating was applied in layers, each layer being baked in air at 525° C for ten minutes. The coating weight was 32 g/m$^2$ of iridium.

The resulting sample was tested as an anode in an electrolyte that was of 285 grams per liter (g/l) of sodium sulfate. The test cell was an unseparated cell maintained at 65° C. and operated at a current density of 15 kiloamps per square meter (kA/m$^2$). Periodically the electrolysis was briefly interrupted. The coated titanium plate anode was removed from the electrolyte, rinsed in deionized water, air dried and then cooled to ambient temperature. There was then applied to the coated plate surface, by firmly manually pressing onto the coating, a strip of self-adhesive, pressure sensitive tape. This tape was then removed from the surface by quickly pulling the tape away from the plate.

The coating remained well-adhered throughout the test, with the anode ultimately failing by anode passivation with the coating still predominantly intact at 1495 kA-hr/m$^2$-gm or iridium.

EXAMPLE 3

An unalloyed grade 1 titanium plate was prepared with suitable surface roughness by grain boundary etching, followed by an oven bake at 525° C. air temperature. A barrier layer titanium oxide coating on the sample plate was produced using an aqueous solution containing a concentration of 0.75 mole/liter of titanium butyl orthotitanate in n-butanol. The sample plate was coated by brush application. Following the first coat, the plate was heated in air at 525° C. for a time of 10 minutes. After cooling of the plate, these coating and treating steps were repeated, there being a total of three coats applied.

This titanium sample plate was then provided with an electrochemically active oxide coating of tantalum oxide and iridium oxide having a 65:35 weight ratio of Ir:Ta, as metal. The coating composition was an aqueous, acidic solution of chloride salts, and the coating was applied in layers, each layer being baked in air at 525° C. for ten minutes. The applied coating weight Was 8.6 g/m$^2$.

The resulting sample was tested as an anode in an electrolyte that was a mixture of 285 grams per liter (g/l) of sodium sulfate and 60 g/l of magnesium sulfate and having a pH of 2. The test cell was an unseparated cell maintained at 65° C. and operated at a current density of 15 kiloamps per square meter (kA/m$^2$). Periodically the electrolysis was briefly interrupted. The coated titanium plate anode was removed for the electrolyte, rinsed in deionized water, air dried and then cooled to ambient temperature. There was then applied to the coated plate surface, by firmly manually pressing onto the coating, a strip of self-adhesive, pressure sensitive tape. This tape was then removed from the surface by quickly pulling the tape away from the plate.

The coating remained well-adhered throughout the test, with and anode ultimately failing by anode passivation with the coating still predominantly intact at 2,578 kA-hr/m$^2$-gm of iridium.

Comparative Example 3A:

A titanium plate sample of unalloyed grade 1 titanium, had the surface preparation of Example 3, and was coated in the manner of Example 3, but the barrier layer coating cycles were increased until an extra heavy, thick barrier layer from 12 coats was obtained. This titanium plate was top coated with the active oxide coating composition of Example 3 and in the manner of Example 3 to a coating weight of 8.1 g/m$^2$. The coated plate was then tested as in Example 3 and owing to the extra thick, heavy barrier layer coating, had an undesirably shortened lifetime to passivation of only 83 kA-hr/m$^2$-gm or iridium.

We claim:

1. A cell for the electrolysis of a dissolved species contained in a bath of said cell and having a cathode with an anode immersed in said bath, which cell has an anode having as its operative surface an electrochemically active surface top coating over a barrier layer undercoating on a substrate metal, with both the substrate metal and the barrier layer coated metal having a surface with a profilometer-measured average surface roughness of at least about 250 microinches and an average surface peaks per inch of at least about 40, with said peaks per inch being basis a lower profilometer threshold limit of 300 microinches and an upper profilometer threshold limit of 400 microinches.

2. The cell of claim 1, wherein both of said surfaces have a profilometer-measured average roughness of at least about 300 microinches and an average surface peaks per inch of at least about 60, basis an upper threshold limit of 400 microinches and a lower threshold limit of 300 microinches.

3. The cell of claim 1, wherein both of said surfaces have a profilometer-measured average distance between the maximum peak and the maximum valley of at least about 1000 microinches.

4. The cell of claim 1, wherein both of said surfaces have a profilometer-measured average distance between the maximum peak and the maximum valley of from about 1500 microinches to about 3500 microinches.

5. The cell of claim 1, wherein both of said surfaces have a profilometer-measured average peaks height of at least about 1000 microinches.

6. The cell of claim 1, wherein both of said surfaces have a profilometer measured average peaks height of from at least about 1500 microinches up to about 3500 microinches.

7. The cell of claim 1, wherein said cell is a flooded cell, a falling electrolyte cell, or a radial jet cell.

8. The cell of claim 1, wherein said anode is immersed in a bath of an anodizing, electroplating or electrowinning cell.

9. The cell of claim 1, wherein said electrode is an anode in electrogalvanizing, electrotinning, sodium sulfate electrolysis or copper foil plating cell.

10. A cell having an anode and a cathode including an electrode for electrolytic processes comprising a melt-sprayed electrically conductive ceramic oxide layer on a metal substrate, and an active electrocatalytic coating carried by the electrically-conductive ceramic oxide layer, characterized in that the melt-sprayed ceramic oxide layer has a profilometer-measured average surface roughness of at least about 250 microinches and an average surface peaks per inch of at least about 40 based on a profilometer upper threshold limit of 400 microinches and a profilometer lower threshold limit of 300 microinches.

11. An electrolytic cell having the electrode according to claim 10 as an anode in electrogalvanizing, electrotinning, electroforming or electrowinning.

* * * * *